US008636542B2

(12) United States Patent
Funahashi

(10) Patent No.: US 8,636,542 B2
(45) Date of Patent: Jan. 28, 2014

(54) ELECTRICAL COAXIAL CONNECTOR

(75) Inventor: Akio Funahashi, Tokyo (JP)

(73) Assignee: Dai-Ichi Seiko Co., Ltd., Kyoto (JP)

( * ) Notice: Subject to any disclaimer, the term of this patent is extended or adjusted under 35 U.S.C. 154(b) by 63 days.

(21) Appl. No.: 13/474,359

(22) Filed: May 17, 2012

(65) Prior Publication Data

US 2012/0295477 A1 Nov. 22, 2012

(30) Foreign Application Priority Data

May 17, 2011 (JP) ..... 2011-110083

(51) Int. Cl.
*H01R 9/05* (2006.01)

(52) U.S. Cl.
USPC ..... 439/582

(58) Field of Classification Search
USPC ..... 439/578, 582, 585, 63, 67
See application file for complete search history.

(56) References Cited

U.S. PATENT DOCUMENTS

| | | | | |
|---|---|---|---|---|
| 3,480,722 | A * | 11/1969 | Van Horssen et al. | 174/87 |
| 4,792,312 | A * | 12/1988 | Yasumoto | 439/640 |
| 5,263,877 | A * | 11/1993 | Mitani | 439/585 |
| 5,772,470 | A * | 6/1998 | Togashi | 439/582 |
| 5,879,190 | A * | 3/1999 | Maruyama et al. | 439/582 |
| 6,503,100 | B2 * | 1/2003 | Yamane | 439/582 |
| 6,508,668 | B1 * | 1/2003 | Yamane | 439/582 |
| 6,572,407 | B1 * | 6/2003 | Ko | 439/582 |
| 6,712,645 | B1 * | 3/2004 | Chou | 439/582 |
| 6,790,082 | B2 * | 9/2004 | Obayashi | 439/582 |
| 7,025,598 | B2 * | 4/2006 | Ikeda | 439/63 |
| 7,351,067 | B2 * | 4/2008 | Chen et al. | 439/63 |
| 7,485,000 | B2 * | 2/2009 | Zeng | 439/582 |
| 8,251,762 | B2 * | 8/2012 | Maier et al. | 439/892 |
| 8,475,206 | B2 * | 7/2013 | Kubo | 439/582 |
| 2002/0187660 | A1 * | 12/2002 | Obayashi | 439/63 |
| 2005/0136700 | A1 * | 6/2005 | Ikeda | 439/63 |
| 2006/0094297 | A1 * | 5/2006 | Wang | 439/578 |
| 2010/0151729 | A1 * | 6/2010 | Chen et al. | 439/585 |
| 2012/0295477 | A1 * | 11/2012 | Funahashi | 439/578 |
| 2013/0149897 | A1 * | 6/2013 | Takano et al. | 439/582 |

FOREIGN PATENT DOCUMENTS

| | | |
|---|---|---|
| JP | 2002-324636 A | 11/2002 |
| JP | 2006-179409 A | 7/2006 |

* cited by examiner

*Primary Examiner* — Alexander Gilman
(74) *Attorney, Agent, or Firm* — Studebaker & Brackett PC

(57) ABSTRACT

Coaxial connector comprising a signal contact member having a connecting terminal portion and a contacting terminal portion, a grounding contact member having an annular engaging portion for engaging with an outer contact member of a mating coaxial connector and a shell portion extending from the annular engaging portion to be connected with an outer conductor of a coaxial cable, and a housing for supporting the signal contact member and the grounding contact member. The connecting terminal portion of the signal contact member is positioned at the outside of the annular engaging portion of the grounding contact member to be connected with a core conductor of the coaxial cable and the contacting terminal portion of the signal contact member is positioned at the inside of the annular engaging portion of the grounding contact member for coming into contact with a central contact member of the mating coaxial connector.

5 Claims, 11 Drawing Sheets

ELECTRICAL COAXIAL CONNECTOR

BACKGROUND OF THE INVENTION

1. Field of the Invention

The present invention relates generally to an electrical coaxial connector, and more particularly to an improvement in an electrical coaxial connector which has a signal contact member and a grounding contact member insulated from each other to be connected respectively with a core conductor and an outer conductor insulated from each other of a coaxial cable provided with an internal insulator put between the core conductor and the outer conductor for surrounding the core conductor and an external insulator for surrounding the outer conductor, and is used to be coupled with a mating coaxial connector fixed, for example, to a circuit board.

2. Description of the Prior Art Including Information Disclosed Under 37 CFR 1.97 and 37 CFR 1.98

There has been often utilized a coaxial cable having a core conductor, an outer conductor, an internal insulator put between the core conductor and the outer conductor for surrounding the core conductor and an external insulator for surrounding the outer conductor for transmitting high-frequency signals between electrical parts, electric equipments or electronic apparatus. The high-frequency signal transmitted through the coaxial cable is put in a condition of electromagnetic shield so as to be inactive to leak out from the core conductor or to prevent noises from mixing thereinto from the outside. For example, the coaxial cable is connected with a circuit board on which high frequency signals are dealt with and the high frequency signal is transmitted through the coaxial cable from the circuit board to the outside or from the outside to the circuit board under the condition of electromagnetic shield.

For connecting the coaxial cable with the circuit board, an electrical coaxial connector is connected with an end of the coaxial cable to be coupled with a mating coaxial connector fixed to the circuit board. The electrical coaxial connector connected with the end of the coaxial cable (hereinafter, referred to as a coaxial cable connector) has a signal contact member with which the core conductor of the coaxial cable is connected and a grounding contact member with which the outer conductor of the coaxial cable is connected. The mating coaxial connector has a central contact member to which the high-frequency signal dealt with on the circuit board is supplied and an outer contact member provided for surrounding the central contact member to be supplied with a ground potential. When the coaxial cable connector is coupled with the mating coaxial connector on the circuit board, the grounding contact member of the coaxial cable connector engages with the outer contact member of the mating coaxial connector to be electrically connected with the same and the signal contact member of the coaxial cable connector comes into press-contact with the central contact member of the mating coaxial connector to be electrically connected with the same.

For such a coupling of the coaxial cable connector with the mating coaxial connector as mentioned above, the mating coaxial connector is fixed to the circuit board with the central contact member and the outer contact member surrounding the central contact member each facing upward on a parts-mountable surface of the circuit board on which various electrical or electronic parts are mounted, so that the coaxial cable connector is moved downward toward the parts-mountable surface of the circuit board to be coupled with the mating coaxial connector in such a manner that the grounding contact member of the coaxial cable connector is engaged with the outer contact member of the mating coaxial connector and the signal contact member of the coaxial cable connector is put in press-contact with the central contact member of the mating coaxial connector. Accordingly, the coaxial cable connector coupled with the mating coaxial connector which is fixed to the circuit board is postured to project from the parts-mountable surface of the circuit board with a predetermined measure of thickness in a direction perpendicular to the parts-mountable surface of the circuit board.

There has been previously proposed one of various types of electrical coaxial connectors, with which a signal contact member is not required for connection with a core conductor of a coaxial cable to be soldered with the core conductor of the coaxial cable so that the electrical coaxial connector is able to be connected easily and appropriately with the end of the coaxial cable, as disclosed in, for example, the Japanese patent application published before examination under publication number 2002-324636 (hereinafter, referred to as published patent document 1).

The previously proposed electrical coaxial connector disclosed in the published patent document 1 comprises a shell (a grounding contact) having an annular engaging portion and a shell-bending portion extending from the annular engaging portion, a connecting terminal member (a signal contact member) having a stationary contact portion and a movable contact portion and a pair of engaging portions each extending from the stationary contact portion, and an insulating member (a housing made of insulator) having a bending portion to be put between the connecting terminal member and the shell. The connecting terminal member is supported by the insulating member and the insulating member is supported by the shell. The stationary contact portion and the movable contact portion extending from the stationary contact portion of the connecting terminal member are so positioned in regard to the annular engaging portion of the shell that the engaging portions extending from the stationary contact portion are surrounded by the annular engaging portion of the shell.

When the electrical coaxial connector proposed previously as mentioned above is connected with the end portion of the coaxial cable to constituting a coaxial cable connector, the core conductor of the coaxial cable is positioned to be correspond to the stationary contact portion of the connecting terminal member, and the movable contact portion of the connecting terminal member, the bending portion of the insulating member and the shell-bending portion of the shell are piled up on the core conductor of the coaxial cable, so that the core conductor of the coaxial cable is put between the stationary contact portion of the connecting terminal member and the movable contact portion of the connecting terminal member to be fixed to and connected with the connecting terminal member and the shell-bending portion of the shell is connected with the outer conductor of the coaxial cable. Then, the coaxial cable connector, that is, the previously proposed electrical coaxial connector disclosed in the published patent document 1 and connected with the end of the coaxial cable, is coupled with a mating coaxial connector fixed to a circuit board, which has a central contact member and an outer contact member surrounding the central contact. In the coaxial cable connector coupled with the mating coaxial connector, the annular engaging portion of the shell is put in engagement with the outer contact member of the mating coaxial connector and the engaging portions extending from the stationary contact portion of the connecting terminal member is put in press-contact with the central contact member of the mating coaxial connector.

When the previously proposed electrical coaxial connector disclosed in the published patent document 1 is connected with the end of the coaxial cable so as to constitute the coaxial cable connector and coupled with the mating coaxial connector fixed to the circuit board, the core conductor of the coaxial cable connected with the connecting terminal member which has the engaging portions extending from the stationary contact portion and positioned to be surrounded by the annular engaging portion of the shell, is put between the stationary contact portion of the connecting terminal member and the movable contact portion of the connecting terminal member. On that occasion, the stationary and movable contacts of the connecting terminal member and the core conductor of the coaxial cable put between the stationary and movable contacts of the connecting terminal member so as to be fixed to and connected with the connecting terminal member are positioned to be piled up on the central contact member of the mating coaxial connector at the inside of the annular engaging portion of the shell. Thereby, the electrical coaxial connector previously proposed for constituting the coaxial cable connector, as disclosed in the published patent document 1, is to be designed to have a measure of thickness thereof on the circuit board to which the mating coaxial connector is fixed, which is increased in a direction perpendicular to the circuit board.

Accordingly, there has been also proposed another electrical coaxial connector in which a measure of thickness thereof on a circuit board to which a mating coaxial connector is fixed is reduced in a direction perpendicular to the circuit board by means of making an improvement in a position where a core conductor of a coaxial cable is connected with a signal contact member of the electrical coaxial connector, as disclosed in, for example, the Japanese patent application published before examination under publication number 2006-179409 (hereinafter, referred to as published patent document 2).

The previously proposed electrical coaxial connector disclosed in the published patent document 2 comprises a metallic shell (a grounding contact member) which has an annular engaging portion, a tongue portion extending from the annular engaging portion and a plurality of pairs of caulking portions formed on the tongue portion, a signal contact member (a contact member) which has a pair of plug connecting terminal portions positioned at the inside of the annular engaging portion of the metallic shell and a pair of cable connecting terminal portions positioned at the outside of the annular engaging portion of the metallic shell, and a housing made of insulator (a insulating housing member) which has a pair of bending portions between which the cable connecting terminal portions of the signal contact are put and is positioned between the signal contact member and the metallic shell. The signal contact member is supported by the housing and the housing is supported by the metallic shell. The cable connecting terminal portions of the signal contact member are positioned to be opposite to each other and the bending portions of the housing are positioned also to be opposite to each other in the same direction as the cable connecting terminal portions of the signal contact member. Each pair of caulking portions formed on the tongue portion of the metallic shell are positioned to be opposite to each other with the bending portions of the housing between.

When the electrical coaxial connector proposed previously as disclosed in the published patent document 2 is connected with an end portion of a coaxial cable to constituting a coaxial cable connector, a core conductor of the coaxial cable is put between the cable connecting terminal portions of the signal contact member positioned at the outside of the annular engaging portion of the metallic shell. Then, each of the caulking portions formed on the tongue portion of the metallic shell to constitute one of the pairs of the caulking portions is bent inside so that the bending portions of the housing are pushed respectively by the caulking portions formed on the tongue portion of the metallic shell to be shifted in its position. Thereby, the cable connecting terminal portions of the signal contact member is moved to approach each other and the core conductor of the coaxial cable is held tightly by the cable connecting terminal portions of the signal contact member to be connected with the signal contact member. Further, each of the caulking portions formed on the tongue portion of the metallic shell to constitute another one of the pairs of the caulking portions is bent inside so that the tongue portion of the metallic shell is connected with an outer conductor of the coaxial cable.

Then, the coaxial cable connector, that is, the electrical coaxial connector proposed previously as disclosed in the published patent document 2 and connected with the end of the coaxial cable, is coupled with a mating coaxial connector fixed to a circuit board, which has a central contact member and an outer contact member surrounding the central contact member. In the coaxial cable connector coupled with the mating coaxial connector, the annular engaging portion of the shell is put in engagement with the outer contact member of the mating coaxial connector and the plug connecting terminal portions positioned at the inside of the annular engaging portion of the metallic shell are put in press-contact with the central contact member of the mating coaxial connector.

The cable connecting terminal portions of the signal contact member are operative to approach each other in a direction perpendicular to a direction along which the annular engaging portion of the metallic shell is moved to engage with the outer contact member of the mating coaxial connector and the bending portions of the housing are operative also to approach each other in the direction perpendicular to the direction along which the annular engaging portion of the metallic shell is moved to engage with the outer contact member of the mating coaxial connector.

In the coaxial cable connector thus constituted with the previously proposed electrical coaxial connector as disclosed in the published patent document 2 and coupled with the mating coaxial connector fixed to the circuit board, the core conductor of the coaxial cable connected with the signal contact member is put tightly between the cable connecting terminal portions of the signal contact member positioned at the outside of the annular engaging portion of the metallic shell so as to be connected with the signal contact member, so that the cable connecting terminal portions of the signal contact member and the central conductor of the coaxial cable held tightly by the cable connecting terminal portions of the signal contact member are not positioned to be piled up on the central contact member of the mating coaxial connector at the inside of the annular engaging portion of the metallic shell. As a result, the electrical coaxial connector previously proposed for constituting the coaxial cable connector, as disclosed in the published patent document 2, is able to be designed to have a measure of thickness thereof on the circuit board to which the mating coaxial connector is fixed, which is reduced in a direction perpendicular to the circuit board.

In the electrical coaxial connector proposed previously as disclosed in the published patent document 2, it is advantageous that the signal contact member is not required for connection with the core conductor of the coaxial cable to be soldered with the core conductor of the coaxial cable and the measure of thickness of the electrical coaxial connector on the circuit board to which the mating coaxial connector is fixed can be reduced in the direction perpendicular to the circuit board, On the other hand, the previously proposed electrical coaxial connector is accompanied with a disadvantage that the housing made of insulator becomes complicated in structure.

That is, the housing of the previously proposed electrical coaxial connector is required to have the bending portions operative to be opposite to each other with the cable connecting terminal portions of the signal contact member between. In addition, the bending portions of the housing are required to be opposite to each other in the direction perpendicular to the direction along which the annular engaging portion of the metallic shell is moved to engage with the outer contact member of the mating coaxial connector fixed on the circuit board and required further to be pushed by the caulking portions formed on the tongue portion of the metallic shell for moving the cable connecting terminal portions of the signal contact member to approach each other when each of the caulking portions formed on the tongue portion of the metallic shell is bent inside. Accordingly, the housing is complicated in its structure so as to require much time for production and assembly thereof and a production cost of the electrical coaxial connector is increased due to the housing.

BRIEF SUMMARY OF THE INVENTION

Accordingly, it is an object of the present invention to provide an electrical coaxial connector used to be coupled with a mating coaxial connector fixed to a circuit board, which comprises a signal contact member with which a core conductor of a coaxial cable is to be connected, a grounding contact member with which an outer conductor of the coaxial cable is to be connected, and a housing made of insulator for supporting the signal contact member and the grounding contact member in such a manner that the signal contact member and the grounding contact member are insulated from each other, and which avoids the aforementioned problems and disadvantages encountered with the prior art.

Another object of the present invention is to provide an electrical coaxial connector used to be coupled with a mating coaxial connector fixed to a circuit board, which comprises a signal contact member with which a core conductor of a coaxial cable is to be connected, a grounding contact member with which an outer conductor of the coaxial cable is to be connected, and a housing made of insulator for supporting the signal contact member and the grounding contact member in such a manner that the signal contact member and the grounding contact member are insulated from each other, and in which the signal contact member is not required for sure and reliable connection with the core conductor of the coaxial cable to be soldered with the core conductor of the coaxial cable.

A further object of the present invention is to provide an electrical coaxial connector used to be coupled with a mating coaxial connector fixed to a circuit board, which comprises a signal contact member with which a core conductor of a coaxial cable is to be connected, a grounding contact member with which an outer conductor of the coaxial cable is to be connected, and a housing made of insulator for supporting the signal contact member and the grounding contact member in such a manner that the signal contact member and the grounding contact member are insulated from each other, and with which a measure of thickness of the electrical coaxial connector on the circuit board to which the mating coaxial connector is fixed can be reduced in a direction perpendicular to the circuit board without complicating the housing in its structure under a situation wherein the electrical coaxial connector is coupled with the mating coaxial connector.

According to the present invention, as claimed in any one of accompanying claims, there is provided an electrical coaxial connector used to be coupled with a mating coaxial connector fixed to a circuit board, which comprises a signal contact member having a connecting terminal portion with which a core conductor of a coaxial cable is to be connected and a contacting terminal portion for coming into contact with a central contact member of the mating coaxial connector, a grounding contact member having an annular engaging portion for engaging with an outer contact member of the mating coaxial connector provided for surrounding the central contact member to be connected with the same and a shell portion extending from the annular engaging portion to be connected with an outer conductor of the coaxial cable, and a housing made of insulator for supporting the signal contact member and the grounding contact member in such a manner that the signal contact member and the grounding contact member are insulated from each other and having a bending press-contact portion extending to be bendable along the shell portion of the grounding contact member and operative to be bent with the shell portion for coming into press-contact with the signal contact member, wherein the contacting terminal portion of the signal contact member is positioned at the inside of the annular engaging portion of the grounding contact member and the connecting terminal portion of the signal contact member is positioned at the outside of the annular engaging portion of the grounding contact member to have a stationary part fixed to the housing and a movable part provided to be shiftable in regard to the stationary part, and the movable part of the connecting terminal portion of the signal contact member is pressed by the bending press-contact portion of the housing to shift toward the stationary part of the connecting terminal portion of the signal contact member so that the core conductor of the coaxial cable is held tightly between the stationary part and the movable part of the connecting terminal portion of the signal contact member to be connected with the connecting terminal portion of the signal contact member when the bending press-contact portion of the housing is caused to come into press-contact with the signal contact member.

In one embodiment of electrical coaxial connector according to the present invention, the grounding contact member has further a housing-receiving portion extending from the annular engaging portion for engaging with a portion of the housing placed at the vicinity of the connecting terminal portion of the signal contact member in addition to the annular engaging portion and the shell portion.

In the electrical coaxial connector thus constituted in accordance with the present invention, the core conductor of the coaxial cable is connected with the connecting terminal portion of the signal contact member and the outer conductor of the coaxial cable is connected with the shell portion of the grounding contact member under the situation wherein the contacting terminal portion of the signal contact member is positioned at the inside of the annular engaging portion of the grounding contact member and the connecting terminal portion of the signal contact member is positioned at the outside of the annular engaging portion of the grounding contact to have the stationary part fixed to the housing and the movable part provided to be shiftable in regard to the stationary part, so that the electrical coaxial connector according to the present invention is connected with the end of the coaxial cable to constitute a coaxial cable connector. On that occasion, for example, the core conductor of the coaxial cable is put on the stationary part of the connecting terminal portion of the signal contact member and then the movable part of the connecting terminal portion of the signal contact member is pressed by the bending press-contact portion of the housing to shift toward the stationary part of the connecting terminal portion of the signal contact member so that the core conductor of the coaxial cable is held tightly between the stationary part and the movable part of the connecting terminal portion of the signal contact member to be connected with the connecting terminal portion of the signal contact member.

In the coaxial cable connector which is constituted with the electrical coaxial connector according to the present invention connected with the end of the coaxial cable in such a manner as described above, since the stationary part and the movable part of the connecting terminal portion of the signal contact member are positioned at the outside of the annular engaging portion of the grounding contact member, the core conductor of the coaxial cable held tightly between the stationary part and the movable part of the connecting terminal portion of the signal contact member is positioned also at the outside of the annular engaging portion of the grounding contact member.

The coaxial cable connector thus constituted with the electrical coaxial connector according to the present invention is, for example, coupled with the mating coaxial connector fixed to the circuit board with the annular engaging portion of the grounding contact member put in engagement with the outer contact member of the mating coaxial connector and the contacting terminal portion of the signal contact member positioned at the inside of the annular engaging portion of the grounding contact member put in press-contact with the central contact member of the mating coaxial connector. In the coaxial cable connector constituted with the electrical coaxial connector according to the present invention and coupled with the mating coaxial connector in such a manner as described above, the stationary part and the movable part of the connecting terminal portion of the signal contact member and the core conductor of the coaxial cable held tightly between the stationary part and the movable part of the connecting terminal portion of the signal contact member are positioned at the outside of the annular engaging portion of the grounding contact member so as not to be piled up on the central contact member of the mating coaxial connector at the inside of the annular engaging portion of the grounding contact member.

Especially, in the embodiment of electrical coaxial connector according to the present invention, the housing-receiving portion extending from the annular engaging portion of the grounding contact member engages with the portion of the housing placed at the vicinity of the connecting terminal portion of the signal contact member so that the housing is reinforced with the housing-receiving portion.

With the electrical coaxial connector according to the present invention, since the stationary part and the movable part of the connecting terminal portion of the signal contact member and the core conductor of the coaxial cable held tightly between the stationary part and the movable part of the connecting terminal portion of the signal contact member are not positioned to be piled up on the central contact member of the mating coaxial connector at the inside of the annular engaging portion of the grounding contact member when the coaxial cable connector which is constituted with the electrical coaxial connector according to the present invention connected with the end of the coaxial cable is coupled with the mating coaxial connector fixed to the circuit board, a measure of thickness of the electrical coaxial connector on the circuit board to which the mating coaxial connector is fixed can be reduced in a direction perpendicular to the circuit board.

Further, when the core conductor of the coaxial cable is connected with the connecting terminal portion of the signal contact member, the bending press-contact portion of the housing is bent with the shell portion of the grounding contact member to press the movable part of the connecting terminal portion of the signal contact member and thereby to cause the same to shift toward the stationary part of the connecting terminal portion of the signal contact member so that the core conductor of the coaxial cable is held tightly between the stationary part and the movable part of the connecting terminal portion of the signal contact member. Therefore, any particular means with which the housing is complicated in its structure is not necessary for connecting the core conductor of the coaxial cable with the connecting terminal portion of the signal contact member. Besides, it is not necessary for connecting the core conductor of the coaxial cable with the signal contact member to solder the core conductor of the coaxial cable with the signal contact member.

As a result, with the electrical coaxial connector according to the present invention, the signal contact member is not required for sure and reliable connection with the core conductor of the coaxial cable to be soldered with the core conductor of the coaxial cable and the measure of thickness of the electrical coaxial connector on the circuit board to which the mating coaxial connector is fixed can be reduced in the direction perpendicular to the circuit board without complicating the housing in its structure under the situation wherein the coaxial cable connector which is constituted with the electrical coaxial connector according to the present invention connected with the end of the coaxial cable is coupled with the mating coaxial connector fixed to the circuit board.

Further, with the embodiment of electrical coaxial connector according to the present invention, since the housing is reinforced with the housing-receiving portion extending from the annular engaging portion of the grounding contact member, it is possible to reduce the thickness of the insulator of which the housing is made without deteriorating a mechanical strength of the housing. This results in a further reduction in the measure of thickness of the electrical coaxial connector on the circuit board to which the mating coaxial connector is fixed.

The above, and other objects, features and advantages of the present invention will become apparent from the following detailed description taken in conjunction with the accompanying drawings.

DETAILED DESCRIPTION OF THE INVENTION

Figure 1:
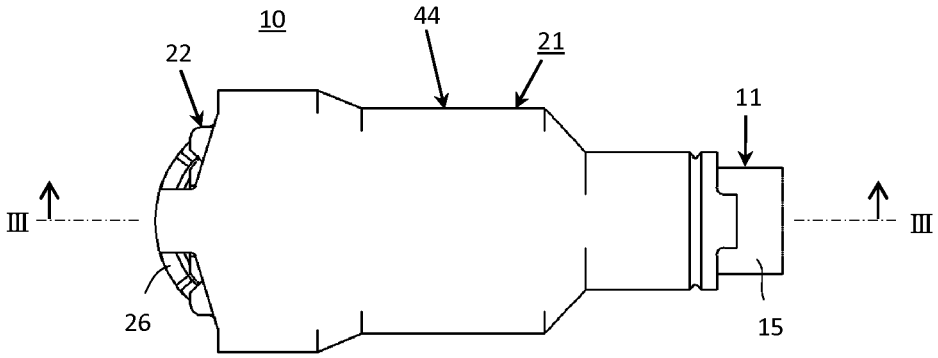
FIG. 1 is a schematic plane view showing an embodiment of electrical coaxial connector according to the present invention, together with an end of a coaxial cable.
Figure 2:
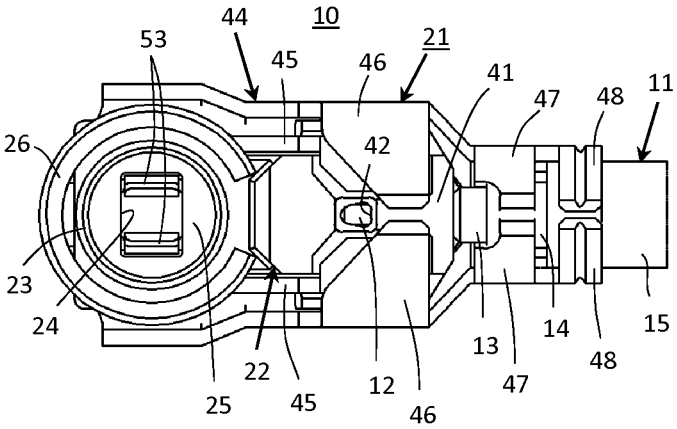
FIG. 2 is a schematic bottom view showing the embodiment of electrical coaxial connector according to the present invention, together with the end of the coaxial cable.
Figure 3:
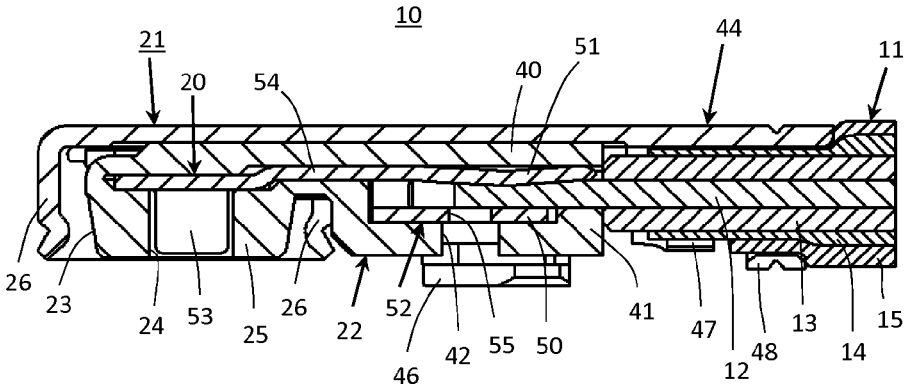
FIG. 3 is a schematic cross sectional view showing a cross section taken along line III-III on FIG. 1.

Each of FIGS. 1, 2 and 3 shows the embodiment of electrical coaxial connector according to the present invention, together with an end of a coaxial cable with which the embodiment is connected to constitute a coaxial cable connector.

Referring to FIGS. 1 to 3, an electrical coaxial connector 10, which constitutes the embodiment of electrical coaxial connector according to the present invention, is connected with an end of a coaxial cable 11 which has a core conductor 12, an inner insulator 13 surrounding closely the core conductor 12, an outer conductor 14 surrounding closely the inner insulator 13 and an outer insulator 15 surrounding closely the outer conductor 14. At the end of the coaxial cable 11, a part of the outer insulator 15 is cut off so that the outer conductor 14 is exposed, and a part of the outer conductor 14 and a part of the inner insulator 13 are further cut off so that the core conductor 12 is exposed.

The electrical coaxial connector 10 comprises a signal contact member 20 made of conductive material to be put in contact with the core conductor 12 of the coaxial cable 11, a grounding contact member 21 made of conductive material to be pit in contact with the outer conductor 14 of the coaxial cable 11 and a housing 22 made of insulator to support the signal contact member 20 and the grounding contact member 21 in such a manner that the signal contact member 20 and the grounding contact member 21 are insulated from each other.

The housing 22 has a base portion 25 having an outer side surface 23 shaped into a circular cone and a rectangular opening 24 formed at a central portion thereof. The grounding contact member 21 has an annular engaging portion 26 surrounding the base portion 25 of the housing 22. The base portion 25 of the housing 22 and the annular engaging portion 26 of the grounding contact member 21 constitute a connectively engaging portion of the electrical coaxial connector 10.

The electrical coaxial connector 10 connected with the end of the coaxial cable 11 to constitute the coaxial cable connector is coupled with a mating coaxial connector 30 (shown in FIGS. 4 and 5 and explained later) with the connectively engaging portion thereof operative to engage with the mating coaxial connector 30.

Figure 4:
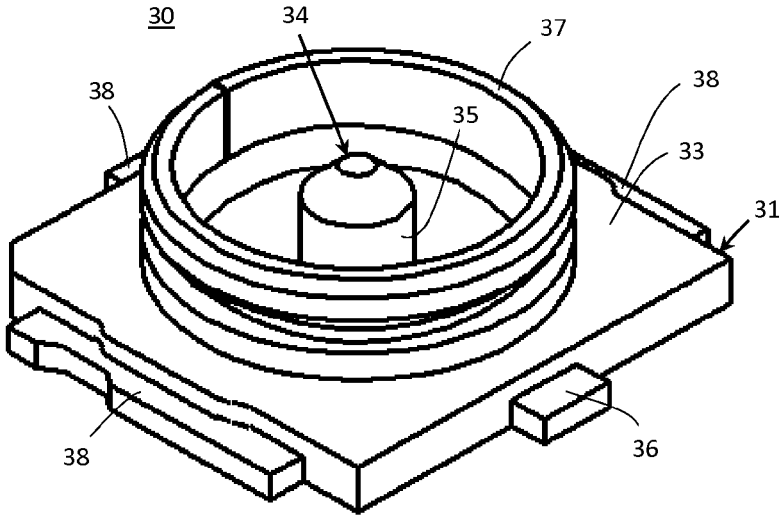
FIG. 4 is a schematic top side perspective view showing an example of a mating coaxial connector with which the embodiment of electrical coaxial connector according to the present invention is coupled.
Figure 5:
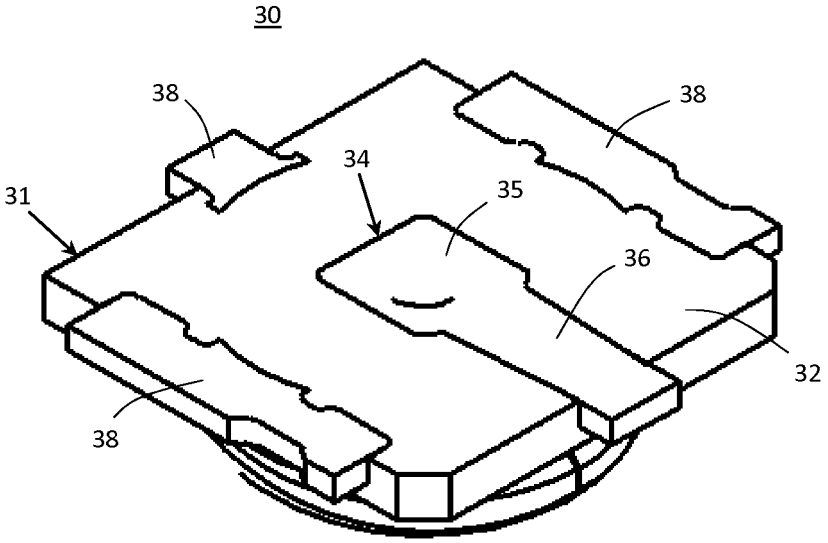
FIG. 5 is a schematic top bottom side perspective view showing the example of the mating coaxial connector with which the embodiment of electrical coaxial connector according to the present invention is coupled.

Each of FIGS. 4 and 5 shows the mating coaxial connector 30 with which the electrical coaxial connector 10 is coupled. The mating coaxial connector 30 is provided with a base board 31 made of insulating material such as plastics to be put on a surface of a circuit board (not shown in the drawings) on which various electric or electronic parts are mounted, so as to cause the mating coaxial connector 30 to be fixed to the surface of the circuit board. The base board 31 of the mating coaxial connector 30 has a bottom plane portion 32 facing closely the surface of the circuit board on which the base board 31 is put and a top plane portion 33 opposite to the bottom plane portion 32. At a central portion of the base board 31, an opening (not shown in the drawings) is formed to pass through the bottom plane portion 32 and the top plane portion 33.

The mating coaxial connector 30 is also provide with a signal transferring conductor 34 fixed to the base board 31. The signal transferring conductor 34 has a central contact member 35 shaped into a column-like member to extend from the bottom plane portion 32 through the opening formed at the central portion of the base board 31 to the top plane portion 33, and a signal connecting member 36 provided on the bottom plane portion 32 to extend from the central contact member 35 to the outside of the base board 31. The central contact member 35 is operative to be connected with the signal contact member 20 of the electrical coaxial connector 10 coupled with the mating coaxial connector 30 and the signal connecting member 36 is operative to be connected, for example, by means of soldering, with a signal terminal provided on the circuit board having the surface on which the base board 31 is put.

The mating coaxial connector 30 is further provided with an outer contact member 37 fixed to the base board 31. The outer contact member 37 is made of conductive material to be shaped into an annular member for surrounding the central contact member 35 on the top plane portion 33 of the base board 31 and provided with a ground connecting portion 38 extending from the outer contact member 37 through the bottom plate portion of the base board 31 to the outside of the base board 31. The outer contact member 37 is operative to be connected with the grounding contact member 21 of the electrical coaxial connector 10 coupled with the mating coaxial connector 30 in a condition wherein the annular engaging portion 26 of the grounding contact member 21 of the electrical coaxial connector 10 engages with the outer contact member 37, and the ground connecting portion 38 is operative to be connected, for example, by means of soldering, with a grounding terminal provided on the circuit board having the surface on which the base board 31 is put.

Incidentally, it is possible to fit up the signal transferring conductor 34 having the signal contact member 20 and the signal connecting member 36 and the outer contact member 37 to the base board 31 by means of insert molding, for example.

Figure 6:
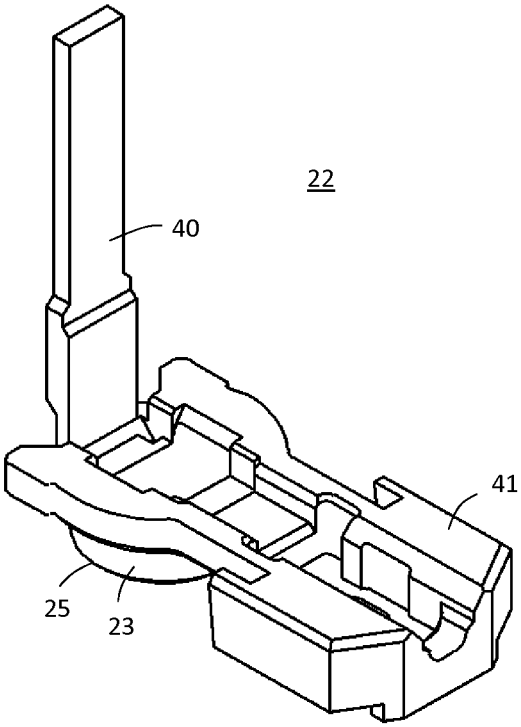
FIG. 6 is a schematic top side perspective view showing a housing made of insulator to be employed in the embodiment of electrical coaxial connector according to the present invention.
Figure 7:
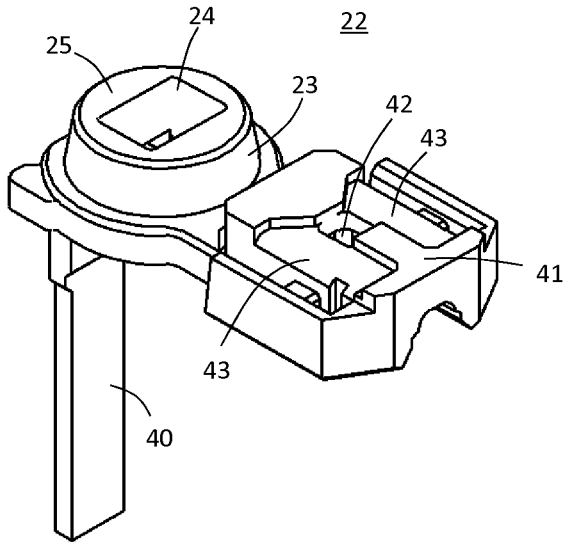
FIG. 7 is a schematic bottom side perspective view showing the housing made of insulator to be employed in the embodiment of electrical coaxial connector according to the present invention.
Figure 8:
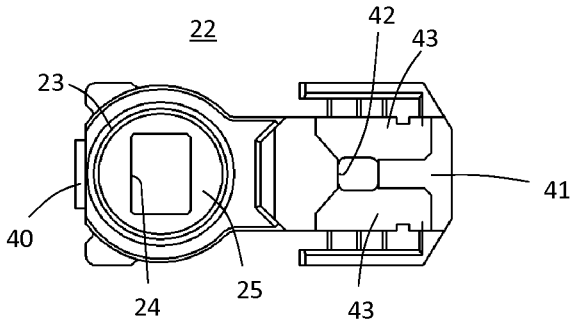
FIG. 8 is a schematic bottom view showing the housing made of insulator to be employed in the embodiment of electrical coaxial connector according to the present invention.

As shown in each of FIGS. 6, 7 and 8, the housing 22 of the electrical coaxial connector 10 has, in addition to the base portion 25, a bending press-contact portion 40 extending from an end of the base portion 25 to be bendable and operative to be bent for coming into press-contact with the signal contact member 20, and a holding portion 41 extending from the base portion 25 to hold the signal contact member 20 and to engage with a plurality of portions of the grounding contact member 21. The bending press-contact portion 40 of the housing 22 is shaped in its entirety into a flat board-like portion, and the holding portion 41 of the housing 22 is provided with an opening 42 formed at a central part thereof and a pair of depressions 43 formed on the bottom side thereof to be opposite to each other with the opening 42 between for receiving respectively a pair of portions of the grounding contact member 21.

Figure 9:
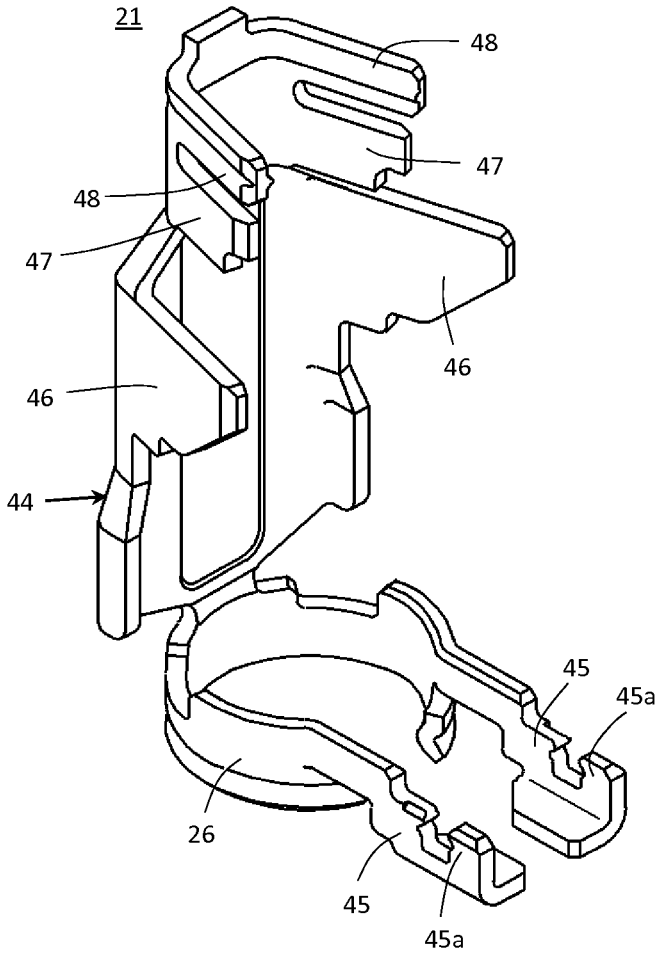
FIG. 9 is a schematic top side perspective view showing a grounding contact member provided to be employed in the embodiment of electrical coaxial connector according to the present invention.
Figure 10:
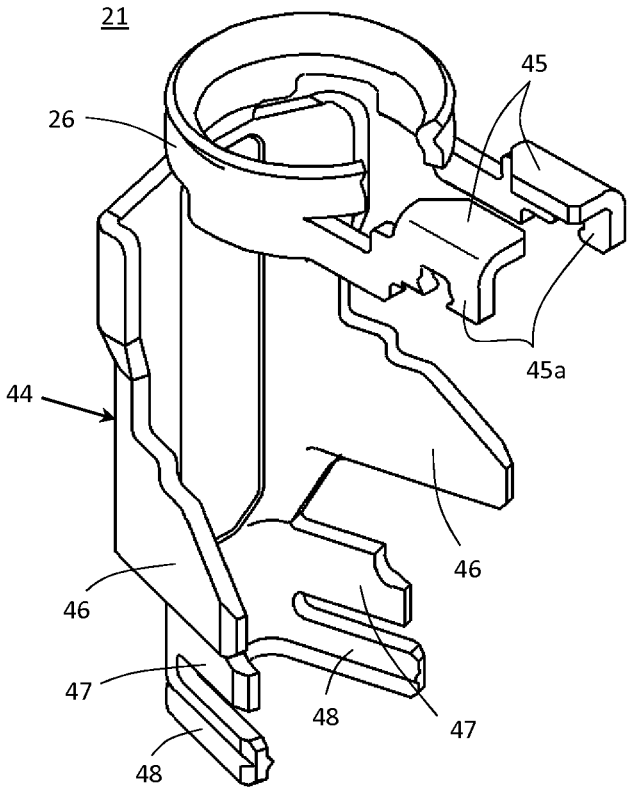
FIG. 10 is a schematic bottom side perspective view showing the grounding contact member provided to be employed in the embodiment of electrical coaxial connector according to the present invention.

As shown in each of FIGS. 9 and 10, the grounding contact member 21 has, in addition to the annular engaging portion 26, a shell portion 44 extending from an end of the annular engaging portion 26 to be bendable and operative to be bent for pressing the bending press-contact portion 40 of the housing 22 to cause the same to be bent and further to be connected with the outer conductor 14 of the coaxial cable 11 having the core conductor 12 connected with the signal contact member 20, and a pair of housing-receiving portions 45 extending from the annular engaging portion 26 to engage respectively with the depressions 43 formed on the holding portion 41 of the housing 22. The bending press-contact portion 40 extends along the shell portion 44 of the grounding contact member 21.

The shell portion 44 of the grounding contact member 21 is provided with a pair of first bendable holding portions 46 which are operative to be bent to approach each other for bending the holding portion 41 of the housing 22, a pair of second bendable holding portions 47 which are operative to be bent to approach each other for holding the outer conductor 14 of the coaxial cable 11 having the core conductor 12 is connected with the signal contact member 20, and a pair of third bendable holding portions 48 which are operative to be bent to approach each other for holding the outer insulator 15 of the coaxial cable 11 having the core conductor 12 is connected with the signal contact member 20. Each of the housing-receiving portions 45 of the grounding contact member 21 is provided with a holding portion 45*a* which is operative to engage with the holding portion 41 of the housing 22 for holding the same, and thereby, each of the housing-receiving portions 45 engages stably and firmly with the holding portion 41 of the housing 22.

Figure 11:
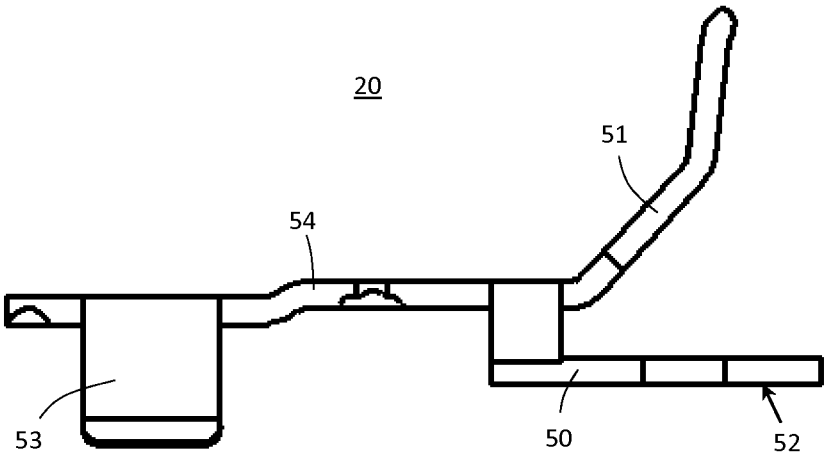
FIG. 11 is a schematic side view showing a signal contact member provided to be employed in the embodiment of electrical coaxial connector according to the present invention.
Figure 12:
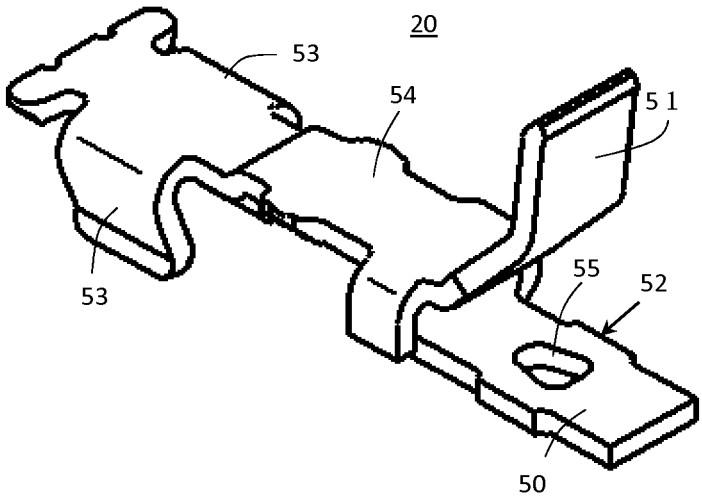
FIG. 12 is a schematic top side perspective view showing the signal contact member provided to be employed in the embodiment of electrical coaxial connector according to the present invention.
Figure 13:
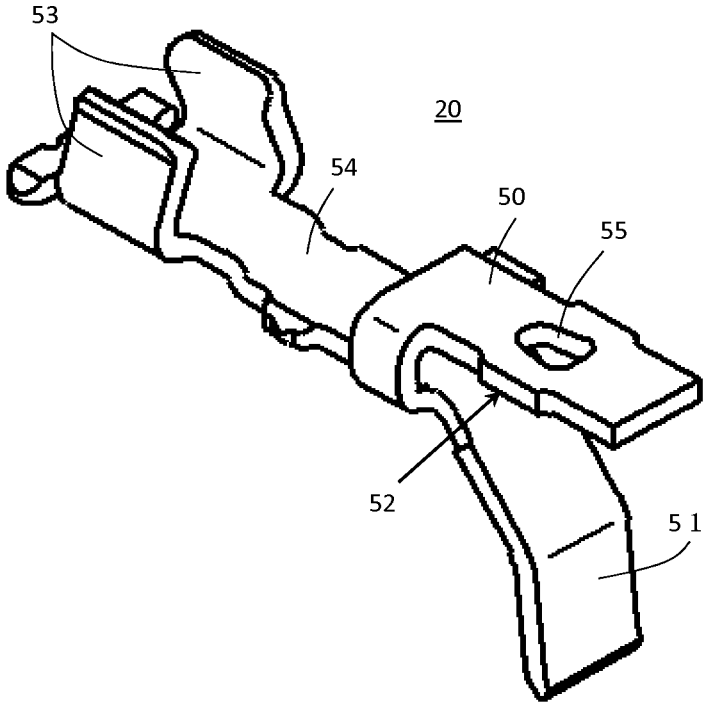
FIG. 13 is a schematic bottom side perspective view showing the signal contact member provided to be employed in the embodiment of electrical coaxial connector according to the present invention.

As shown in each of FIGS. 11, 12 and 13, the signal contact member 20 of the electrical coaxial connector 10 has a connecting terminal portion 52 which comprises a stationary part 50 shaped into a flat board-like part and fixed to the holding portion 41 of the housing 22 and a movable part 51 shaped into a flat board-like part and connected with the stationary part 50 to be shiftable in regard to the stationary part 50 and with which the core conductor 12 of the coaxial cable 11 is connected, a pair of contacting terminal portions 53 which are operative to come into contact with the central contact member 35 of the mating coaxial connector 30 when the electrical coaxial connector 10 is coupled with the mating coaxial connector 30, and a flat connecting portion 54 which connects the contacting terminal portions 53 with the connecting terminal portion 52. An opening 55 is formed at a central portion of the stationary part 50 of the connecting terminal portion 52 so as to be positioned to correspond to the opening 42 formed at the central part of the holding portion 41 of the housing 22.

The signal contact member 20 thus constituted with the connecting terminal portion 52, the contacting terminal portions 53 and the flat connecting portion 54 is formed in a body, for example, by means of punching and bending a resilient metal thin plate. When the core conductor 12 of the coaxial cable 11 is connected with the connecting terminal portion 52 of the signal contact member 20, the core conductor 12 of the coaxial cable 11 is put on the stationary part 50 of the connecting terminal portion 52 and then the bending press-contact portion 40 of the housing 22 is caused to come into press-contact with the signal contact member 20 and thereby the movable part 51 of the connecting terminal portion 52 is pressed by the bending press-contact portion 40 of the housing 22 to shift toward the stationary part 50 of the connecting terminal portion 52 so that the core conductor 12 of the coaxial cable 11 is held tightly between the stationary part 50 and the movable part 51 of the connecting terminal portion 52.

Figure 14:
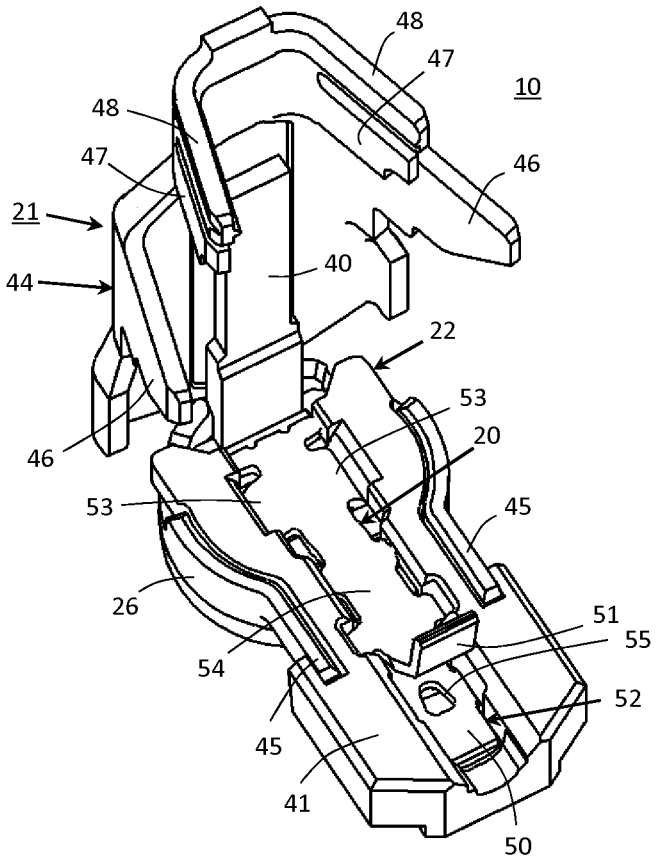
FIG. 14 is a schematic top side perspective view showing the embodiment of electrical coaxial connector according to the present invention.
Figure 15:
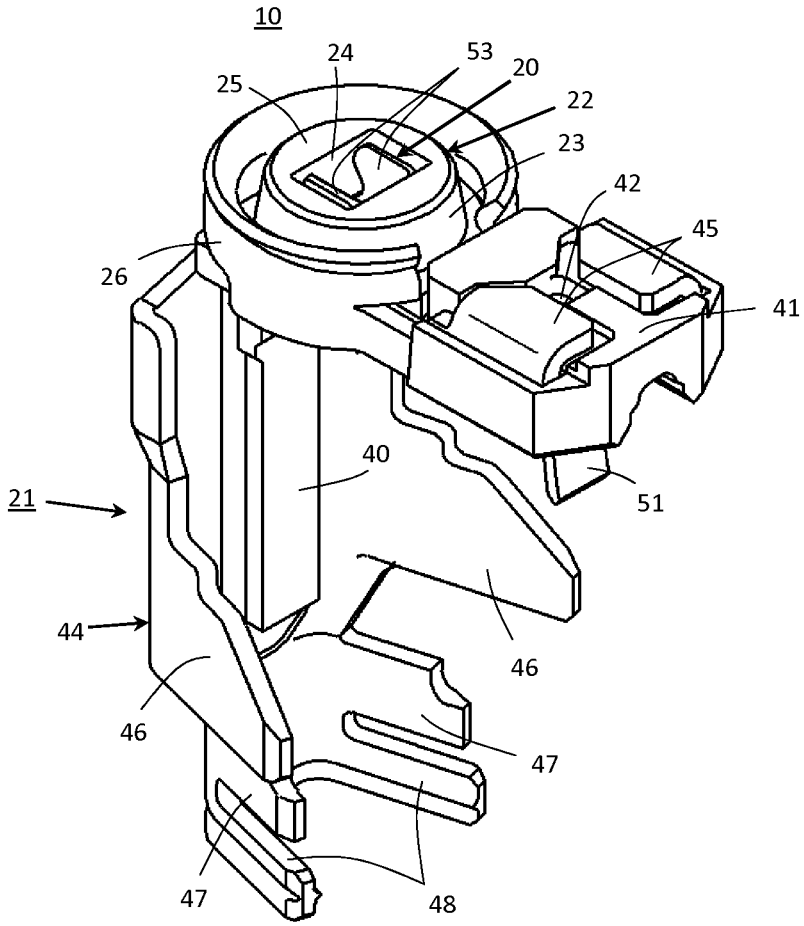
FIG. 15 is a schematic bottom side perspective view showing the embodiment of electrical coaxial connector according to the present invention.
Figure 16:
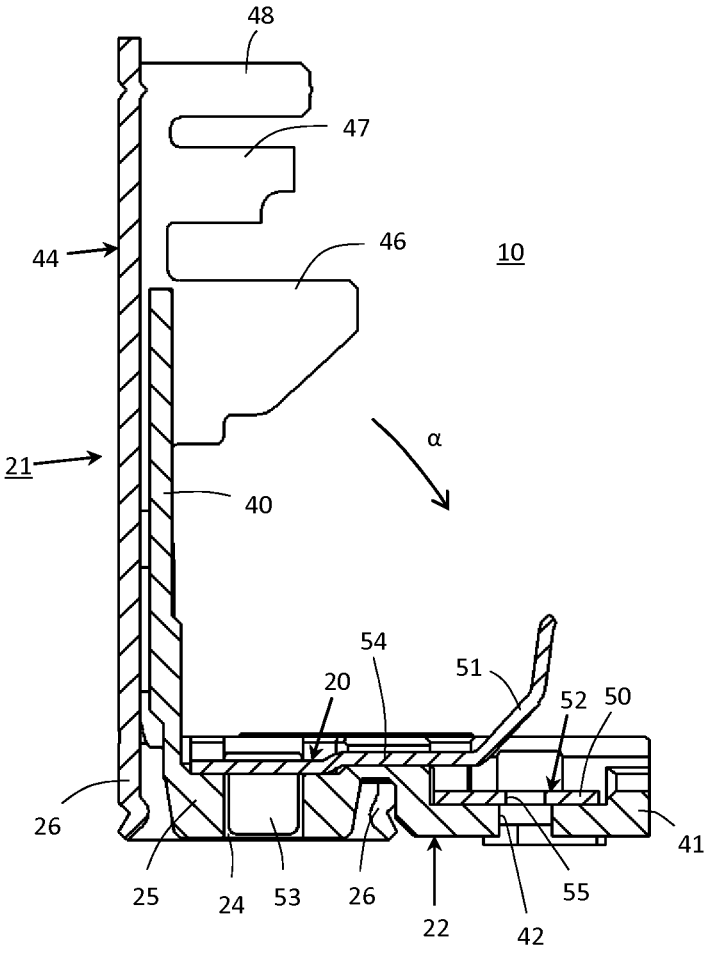
FIG. 16 is a schematic cross sectional view showing the embodiment of electrical coaxial connector according to the present invention.

The electrical coaxial connector 10 is assembled with the signal contact member 20 shown in FIGS. 11 to 13, the grounding contact member 21 shown in FIGS. 9 and 10, and the housing 22 shown in FIGS. 6 to 8 provided for supporting both of the signal contact member 20 and the grounding contact member 21 so as to cause the signal contact member 20 and the grounding contact member 21 to be insulated from each other, as shown in FIGS. 14, 15 and 16.

Referring to FIGS. 14 to 16, in an example of assembly of the electrical coaxial connector 10, first, the signal contact member 20 is fixed to the housing 22 in such a manner that the contacting terminal portion 53 of the signal contact member 20 is inserted into the rectangular opening 24 formed on the base portion 25 of the housing 22 and the connecting terminal portion 52 of the signal contact member 20 is held by the holding portion 41 of the housing 22. In the connecting terminal portion 52 of the signal contact member 20 held by the holding portion 41 of the housing 22, the stationary part 50 thereof is fixed to the holding portion 41 of the housing 22 and the movable part 51 thereof is operative to shift to approach or go away from the stationary part 50 fixed to the holding portion 41 of the housing 22. When the stationary part 50 of the connecting terminal portion 52 of the signal contact member 20 is fixed to the holding portion 41 of the housing 22, the opening 55 formed on the stationary part 50 is positioned to correspond to the opening 42 formed on the holding portion 41.

Then, the grounding contact member 21 is fixed to the housing 20 to which the signal contact member 20 is fixed. In the housing 22 to which the grounding contact member 21 is fixed, the base portion 25 of the housing 22 is positioned at the inside of the annular engaging portion 26 of the grounding contact member 21 and the bending press-contact portion 40 of the housing 22 extends from the base portion 25 of the housing 22 along the shell portion 44 of the grounding contact member 21, which extends from the annular engaging portion 26 of the grounding contact member 21, as shown in FIG. 16. Further, the housing-receiving portions 45 extending from the annular engaging potion 26 of the grounding contact member 21 engages respectively with the depressions 43 formed on the bottom side of the holding portion 41 of the housing 22.

In the housing-receiving portions 45 of the grounding contact member 21 put in engagement with the depressions 43 formed on the bottom side of the holding portion 41 of the housing 22, the holding portion 45*a* provided on each of the housing-receiving portions 45 engages with the holding portion 41 of the housing 22 for holding the same. Thereby, each of the housing-receiving portions 45 engages stably and firmly with the holding portion 41 of the housing 22 and the housing 22 is reinforced with the housing-receiving portions 45.

Since the housing 22 is reinforced with the housing-receiving portions 45 of the grounding contact member 21 as described above, it is possible to reduce the thickness of the insulator of which the housing 22 is made without deteriorating a mechanical strength of the housing 22, so that a measure of thickness of the electrical coaxial connector 10 on the surface of the circuit board to which the mating coaxial connector 30 is fixed can be reduced in a direction perpendicular to the surface of the circuit board under a situation wherein the electrical coaxial connector 10 is coupled with the mating coaxial connector 30 fixed to the surface of the circuit board.

In the electrical coaxial connector 10 thus assembled with the signal contact member 20 and the grounding contact member 21 supported by the housing 22, the contacting terminal portions 53 of the signal contact member 20 are positioned at the inside of the annular engaging portion 26 of the grounding contact member 21 and the connecting terminal portion 52 having the stationary part 50 and the movable part 51 is positioned at the outside of the annular engaging portion 26 of the grounding contact member 21.

Figure 17:
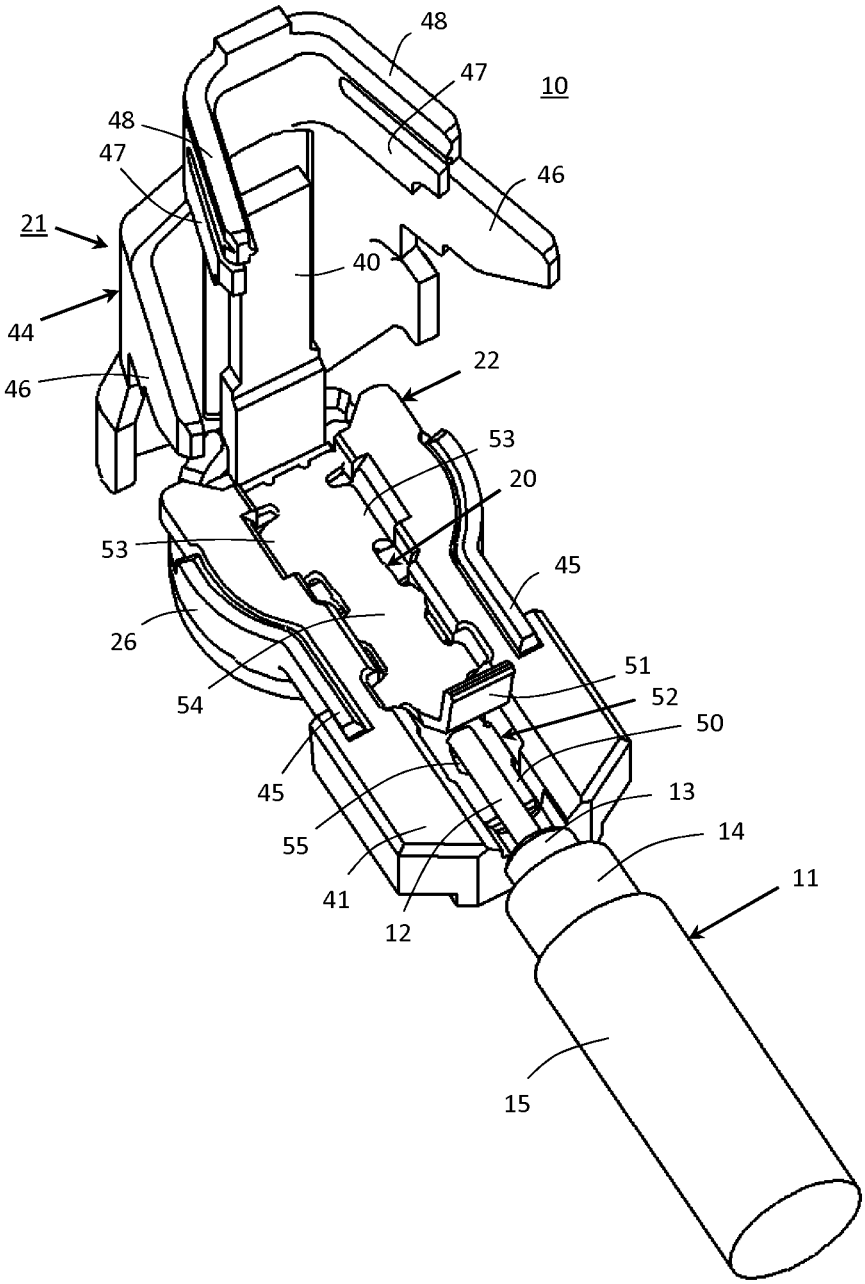
FIG. 17 is a schematic cross sectional view showing the embodiment of electrical coaxial connector according to the present invention on the way to connection with the end of the coaxial cable.

When the electrical coaxial connector 10 is connected with the end of the coaxial cable 11, the part of the outer insulator 15 is cut off so that the outer conductor 14 is exposed and each of the part of the outer conductor 14 and the part of the inner insulator 13 is further cut off so that the core conductor 12 is exposed at the end of the coaxial cable 11, and then the core conductor 12 exposed at the end of the coaxial cable 11 is put on the stationary part 50 of the connecting terminal portion 52 of the signal contact member 20, as shown in FIG. 17. On that occasion, the core conductor 12 of the coaxial cable 11 is positioned between the stationary part 50 and the movable part 51 of the connecting terminal portion 52 so as to cover the opening 55 formed on the stationary part 50 of the connecting terminal portion 52.

After that, the shell portion 44 of the grounding contact member 21 is bent in a direction toward the holding portion 41 of the housing 22 as shown with a curved arrow a in FIG. 16, together with the bending press-contact portion 40 of the housing 22, to be postured almost in parallel with the holding portion 41 of the housing 22. The bending press-contact portion 40 of the housing 22 which is belt in accompany with the shell portion 44 of the grounding contact member 21 comes into press-contact with the movable part 51 of the connecting terminal portion 52 of the signal contact member 20 to cause the same to shift toward the stationary part 50 of the connecting terminal portion 52 of the signal contact member 20 so that the core conductor 12 of the coaxial cable 11 is held tightly between the stationary part 50 and the movable part 51 of the connecting terminal portion 52 of the signal contact member 20. Thereby, the core conductor 12 of the coaxial cable 11 is electrically connected with the connecting terminal portion 52 of the signal contact member 20. On that occasion, it is not necessary to solder the core conductor 12 of the coaxial cable 11 with the connecting terminal portion 52 of the signal contact member 20. Further, a pressure exerted on the stationary part 50 of the connecting terminal portion 52 of the signal contact member 20 is received by the holding portion 41 of the housing 22 and the housing-receiving portions 45 extending from the annular engaging portion 26 of the grounding contact member 21 with sufficient structural strength, so that deformations or the like in the electrical coaxial connector 10 is avoided.

Each of the connecting terminal portion 52 of the signal contact member 20 and the core conductor 12 of the coaxial cable 11 connected with the connecting terminal portion 52 of the signal contact member 20 is positioned at the outside of the annular engaging portion 26 of the grounding contact member 21. In the signal contact member 20 having the connecting terminal portion 52 with which the core conductor 12 of the coaxial cable 11 is connected, each of the contacting terminal portions 53 and the connecting terminal portion 52 projects from the flat connecting portion 54 in the same direction toward the surface of the circuit board on which the electrical coaxial connector 10 is fixed. These contribute to reduction in the measure of thickness of the electrical coaxial connector 10 on the surface of the circuit board to which the mating coaxial connector 30 is fixed.

Finally, each pair of the first bendable holding portions 46, the second bendable holding portions 47 and the third bendable holding portions 48 provided on the shell portion 44 of the grounding contact member 21 are bent to approach each other so that the holding portion 41 of the housing 22 is held by the first bendable holding portions 46, the outer conductor 14 of the coaxial cable 11 is held by the second bendable holding portions 47 and the outer insulator 15 of the coaxial cable 11 is held by the third bendable holding portions 48. As a result, the electrical coaxial connector 10 connected with the end of the coaxial cable 11 for constituting the coaxial cable connector as shown in FIGS. 1 to 3 is obtained.

In the situation wherein the electrical coaxial connector 10 is connected with the end of the coaxial cable 11 for constituting the coaxial cable connector, the opening 55 formed on the stationary part 50 of the connecting terminal portion 52 of the signal contact member 20 is positioned to correspond to the opening 42 formed on the holding portion 41 of the housing 22 and therefore the core conductor 12 of the coaxial cable 11 which is connected with the connecting terminal portion 52 of the signal contact member 20 can be visually observed through the openings 42 and 55 from the bottom side of the holding portion 41 of the housing 22. With such a visual observation, a condition wherein the core conductor 12 of the coaxial cable 11 is correctly connected with the connecting terminal portion 52 of the signal contact member 20 can be easily confirmed.

With the electrical coaxial connector 10 as described above, since the stationary part 50 and the movable part 51 of the connecting terminal portion 52 of the signal contact member 20 and the core conductor 12 of the coaxial cable 11 held tightly between the stationary part 50 and the movable part 51 of the connecting terminal portion 52 of the signal contact member 20 are not positioned to be piled up on the central contact member 35 of the mating coaxial connector 30 at the inside of the annular engaging portion 26 of the grounding contact member 21 when the electrical coaxial connector 10 connected with the end of the coaxial cable 11 is coupled with the mating coaxial connector 30 fixed to the circuit board and in addition each of the contacting terminal portions 53 and the connecting terminal portion 52 projects from the flat connecting portion 54 in the same direction toward the surface of the circuit board on which the electrical coaxial connector 10 is fixed, the measure of thickness of the electrical coaxial connector 10 on the surface of the circuit board to which the mating coaxial connector 30 is fixed can be effectively reduced in the direction perpendicular to the surface of the circuit board.

Further, when the core conductor 12 of the coaxial cable 11 is connected with the connecting terminal portion 52 of the signal contact member 20, the bending press-contact portion 40 of the housing 22 is bent with the shell portion 44 of the grounding contact member 21 to press the movable part 51 of the connecting terminal portion 52 of the signal contact member 20 and thereby to cause the same to shift toward the stationary part 50 of the connecting terminal portion 52 of the signal contact member 20 so that the core conductor 12 of the coaxial cable 11 is held tightly between the stationary part 50 and the movable part 51 of the connecting terminal portion 52 of the signal contact member 20. Therefore, any particular means with which the housing 22 is complicated in its structure is not necessary for connecting the core conductor 12 of the coaxial cable 11 with the connecting terminal portion 52 of the signal contact member 20. Besides, it is not necessary for connecting the core conductor 12 of the coaxial cable 11 with the signal contact member 20 to solder the core conductor 12 of the coaxial cable 11 with the signal contact member 20.

As a result, with the electrical coaxial connector 10, the signal contact member 20 is not required for sure and reliable connection with the core conductor 12 of the coaxial cable 11 to be soldered with the core conductor 12 of the coaxial cable 11 and the measure of thickness of the electrical coaxial connector 10 on the surface of the circuit board to which the mating coaxial connector 30 is fixed can be reduced in the direction perpendicular to the surface of the circuit board without complicating the housing 22 in its structure under the situation wherein the coaxial cable connector which is constituted with the electrical coaxial connector 10 connected with the end of the coaxial cable 11 is coupled with the mating coaxial connector 30 fixed to the circuit board.

Further, since the housing 22 is reinforced with the housing-receiving portions 45 extending from the annular engaging portion 26 of the grounding contact member 21, it is possible to reduce the thickness of the insulator of which the housing 22 is made without deteriorating a mechanical strength of the housing 22. This results in a further reduction in the measure of thickness of the electrical coaxial connector 10 on the surface of the circuit board to which the mating coaxial connector 30 is fixed.

The invention claimed is:

1. An electrical coaxial connector comprising;

a signal contact member having a connecting terminal portion with which a core conductor of a coaxial cable is to be connected and a contacting terminal portion for coming into contact with a central contact member of a mating coaxial connector fixed to a circuit board, a grounding contact member having an annular engaging portion for engaging with an outer contact member of the mating coaxial connector provided for surrounding the central contact member of the mating coaxial connector to be connected with the same and a shell portion extending from the annular engaging portion to be connected with an outer conductor of the coaxial cable, and a housing made of insulator for supporting the signal contact member and the grounding contact member in such a manner that the signal contact member and the grounding contact member are insulated from each other and having a bending press-contact portion extending to be bendable along the shell portion of the grounding contact member and operative to be bent with the shell portion of the grounding contact member for coming into press-contact with the signal contact member, wherein the contacting terminal portion of the signal contact member is positioned at the inside of the annular engaging portion of the grounding contact member and the connecting terminal portion of the signal contact member is positioned at the outside of the annular engaging portion of the grounding contact member to have a stationary part fixed to the housing and a movable part provided to be shiftable in regard to the stationary part, and wherein the movable part of the connecting terminal portion of the signal contact member is pressed by the bending press-contact portion of the housing to shift toward the stationary part of the connecting terminal portion of the signal contact member so that the core conductor of the coaxial cable is held tightly between the stationary part and the movable part of the connecting terminal portion of the signal contact member to be connected with the connecting terminal portion of the signal contact member when the bending press-contact portion of the housing is caused to come into press-contact with the signal contact member.

2. An electrical coaxial connector according to claim 1, wherein the movable part of the connecting terminal portion of the signal contact member is operative to shift toward the stationary part of the connecting terminal portion of the signal contact member, on which the core conductor of the coaxial cable is put, so that the core conductor of the coaxial cable is held tightly between the stationary part and the movable part of the connecting terminal portion of the signal contact member.

3. An electrical coaxial connector according to claim 1, wherein a couple of openings are formed respectively on the stationary part of the connecting terminal portion of the signal contact member and a portion of the housing corresponding to the stationary part of the connecting terminal portion of the signal contact member to be positioned to correspond to each other, so that a condition wherein the core conductor of the coaxial cable is connected with the connecting terminal portion of the signal contacting member is able be confirmed by visual observation through the openings.

4. An electrical coaxial connector according to claim 1, wherein the signal contacting member has a flat connecting portion for connecting the contacting terminal portion with the connecting terminal portion, and each of the contacting terminal portion and the connecting terminal portion projects from the flat connecting portion in the same direction when the core conductor of the coaxial cable is connected with the connecting terminal portion of the signal contact member.

5. An electrical coaxial connector according to claim 1, wherein the grounding contact member has a housing-receiving portion extending from the annular engaging portion for engaging with a portion of the housing positioned in the vicinity of the connecting terminal portion of the signal contact member.

* * * * *